US008205341B2

(12) United States Patent
Rosso et al.

(10) Patent No.: US 8,205,341 B2
(45) Date of Patent: Jun. 26, 2012

(54) TOOL WITH REPLACEABLE BLADE

(75) Inventors: Aaron Charles Rosso, Chicago, IL (US); Matthew Earle Myers, Naperville, IL (US); Amar Arvind Patel, South Barrington, IL (US); Scott Fong, Brisbane (AU)

(73) Assignee: United States Gypsum Company, Chicago, IL (US)

( * ) Notice: Subject to any disclaimer, the term of this patent is extended or adjusted under 35 U.S.C. 154(b) by 1011 days.

(21) Appl. No.: 11/865,548

(22) Filed: Oct. 1, 2007

(65) Prior Publication Data

US 2009/0084233 A1 Apr. 2, 2009

(51) Int. Cl.
*B26B 3/00* (2006.01)

(52) U.S. Cl. ..... 30/169; 30/335; 30/339; 30/342

(58) Field of Classification Search ..... 30/167–169, 30/342, 335–339; 15/245.1, 236.1; 7/105
See application file for complete search history.

(56) References Cited

U.S. PATENT DOCUMENTS

| | | | | |
|---|---|---|---|---|
| 1,030,321 | A | 6/1912 | Müller | |
| 1,458,171 | A * | 6/1923 | Donaldson | 279/97 |
| 1,617,563 | A * | 2/1927 | Baum | 30/321 |
| 3,853,495 | A | 12/1974 | Shire | |
| 3,983,759 | A | 10/1976 | Linden | |
| 4,106,181 | A | 8/1978 | Mattchen | |
| 4,292,738 | A | 10/1981 | Osada | |
| 4,386,609 | A | 6/1983 | Mongeon | |
| 4,524,514 | A * | 6/1985 | Mallalieu et al. | 30/169 |
| 4,620,369 | A * | 11/1986 | Gercken | 30/329 |
| 4,794,694 | A | 1/1989 | Daniel et al. | |
| 5,155,913 | A | 10/1992 | Marttiini | |
| 5,251,352 | A * | 10/1993 | Cullison | 7/105 |
| RE34,979 | E | 6/1995 | Gringer | |
| 5,575,030 | A | 11/1996 | Girard | |
| 5,933,916 | A | 8/1999 | Loschelder | |
| 5,956,799 | A * | 9/1999 | Panaccione et al. | 15/236.01 |
| 6,085,424 | A * | 7/2000 | Mai | 30/169 |
| 6,256,889 | B1 * | 7/2001 | Zuro | 30/339 |
| 6,334,254 | B1 * | 1/2002 | Wonderley | 30/169 |
| 6,367,854 | B1 * | 4/2002 | Chou | 294/57 |
| 6,668,751 | B1 * | 12/2003 | Henke | 116/200 |
| 6,886,257 | B2 | 5/2005 | Chih | |
| 7,434,318 | B2 * | 10/2008 | Perez et al. | 30/169 |
| 2001/0020331 | A1 * | 9/2001 | Stein et al. | 30/136 |
| 2002/0104182 | A1 | 8/2002 | Panfili et al. | |
| 2005/0188541 | A1 | 9/2005 | Brown et al. | |
| 2005/0193566 | A1 | 9/2005 | Brown et al. | |
| 2008/0134846 | A1 * | 6/2008 | Potempa et al. | 81/489 |

* cited by examiner

*Primary Examiner* — Boyer D Ashley
*Assistant Examiner* — Omar Flores-Sánchez
(74) *Attorney, Agent, or Firm* — Greer, Burns & Crain, Ltd.; Pradip Sahu; Philip T. Petti

(57) ABSTRACT

A tool is provided, having a handle with a blade chamber defining a blade chamber cavity, a first locking element, and a second locking element that is user actuated, and a removable blade with a tang engageable in the blade chamber cavity and a working portion. A blade sleeve, is also provided, at least a portion of which is located on the tang.

8 Claims, 8 Drawing Sheets

TOOL WITH REPLACEABLE BLADE

BACKGROUND OF THE INVENTION

The present invention generally relates to hand tools, and more particularly to a wallboard joint taping knife with a replaceable blade.

Taping knives or tools, which have varying blade widths, are used to finish wallboard construction projects and create a smooth transition between abutting wallboard surfaces. After wallboard panels are in place, a smaller (e.g. 4 inch-6 inch) taping knife is generally used to apply a settable joint compound and drywall tape to the joints formed by the abutting wallboard surfaces. At this stage, unseated nails must also be finally set into the wallboards and supporting studs. After the joint compound dries, progressively larger (e.g. 8 inch-14 inch) knives are used to apply more compound to the joint areas. This step is repeated, with intermittent sanding steps, until the joint is sufficiently flat and smooth.

Presently, performing a wallboard joint finishing job generally requires the use of several taping knives as described above. Wallboard finishing practitioners typically need to purchase, carry and maintain a wide variety of taping knives of varying blade widths. Also, conventional taping knives used by professionals frequently need replacement due to worn or corroded blades.

BRIEF SUMMARY OF THE INVENTION

The present taping knife features a replaceable blade. The handle has a blade chamber into which a blade having a working portion, a blade sleeve and a tang opposite the working portion is inserted in a releasably locking engagement. A positive engagement between the handle and the blade helps to restrict movement of the blade with respect to the handle. The blade sleeve helps to create this positive engagement. At least two locking elements provide the releasable locking engagement and also help to provide the positive connection between the handle and the blade.

More specifically, a tool is provided, having a handle with a blade chamber defining a blade chamber cavity, a first locking element, and a second locking element that is user actuated, and a removable blade with a tang engageable in the blade chamber cavity and a working portion. A blade sleeve, is also provided, at least a portion of which is located on the tang.

In another embodiment, a handle for a tool having the handle and a blade, includes a blade chamber defining a blade chamber cavity, a first locking element provided with a biasing element, and a second locking element that is user actuated.

In another embodiment, a blade is provided for a tool with a handle having a blade chamber defining a blade chamber cavity, a first locking element and a second locking element that is user actuated. The blade includes a tang, a working portion, a first locking element receiving portion, a second locking element receiving portion, and a blade sleeve comprising handle mating portions.

In yet another embodiment, a blade sleeve is provided for a tool having a handle with a blade chamber defining a blade chamber cavity and a blade with a tang and a working portion. The blade sleeve includes handle mating portions and a blade mating portion. The blade sleeve is constructed and arranged to provide a positive connection when the blade is inserted into the blade chamber cavity of the handle.

DETAILED DESCRIPTION OF THE INVENTION

Figure 1:
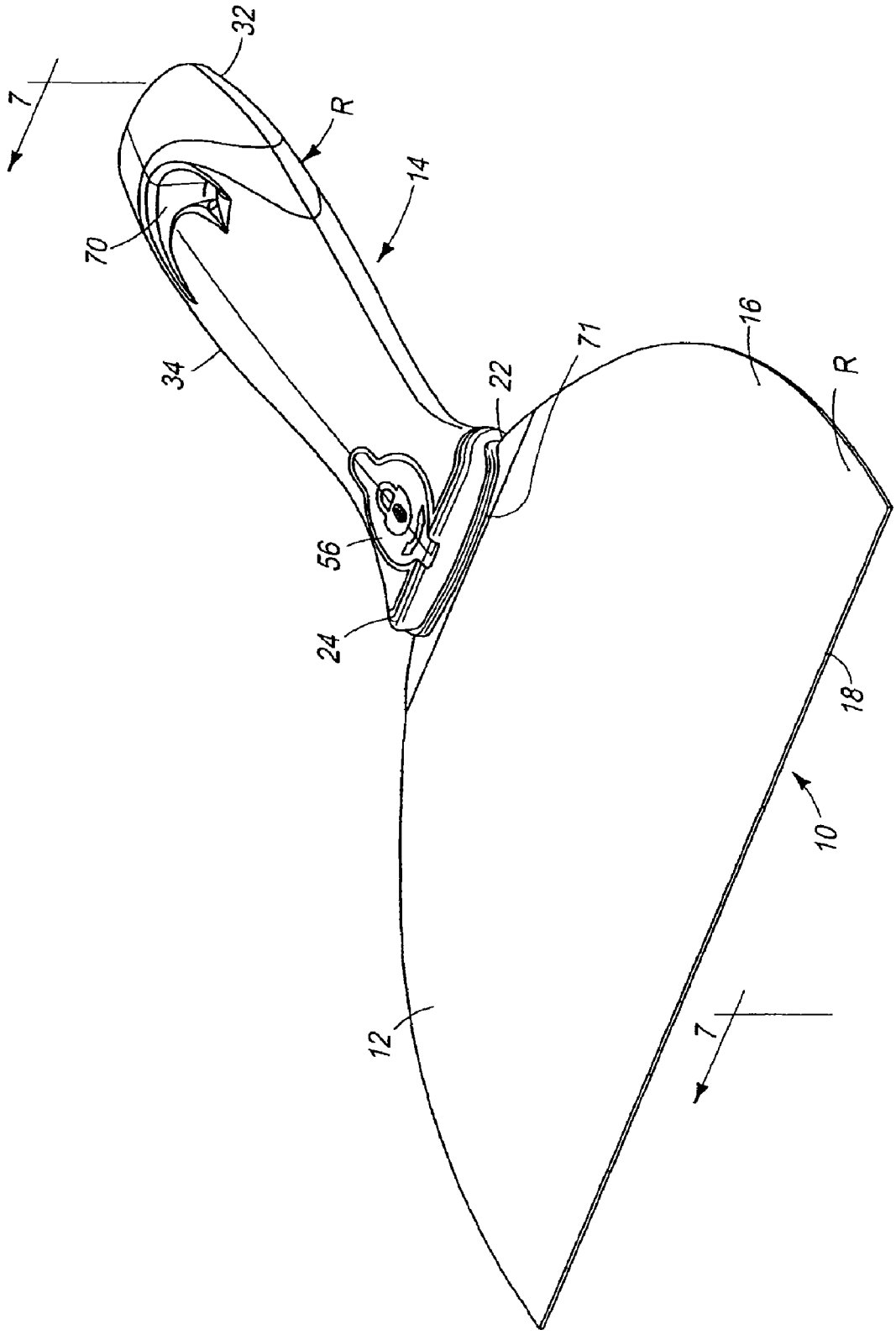
FIG. 1 is a top perspective view of an embodiment of the present taping knife.
Figure 2:
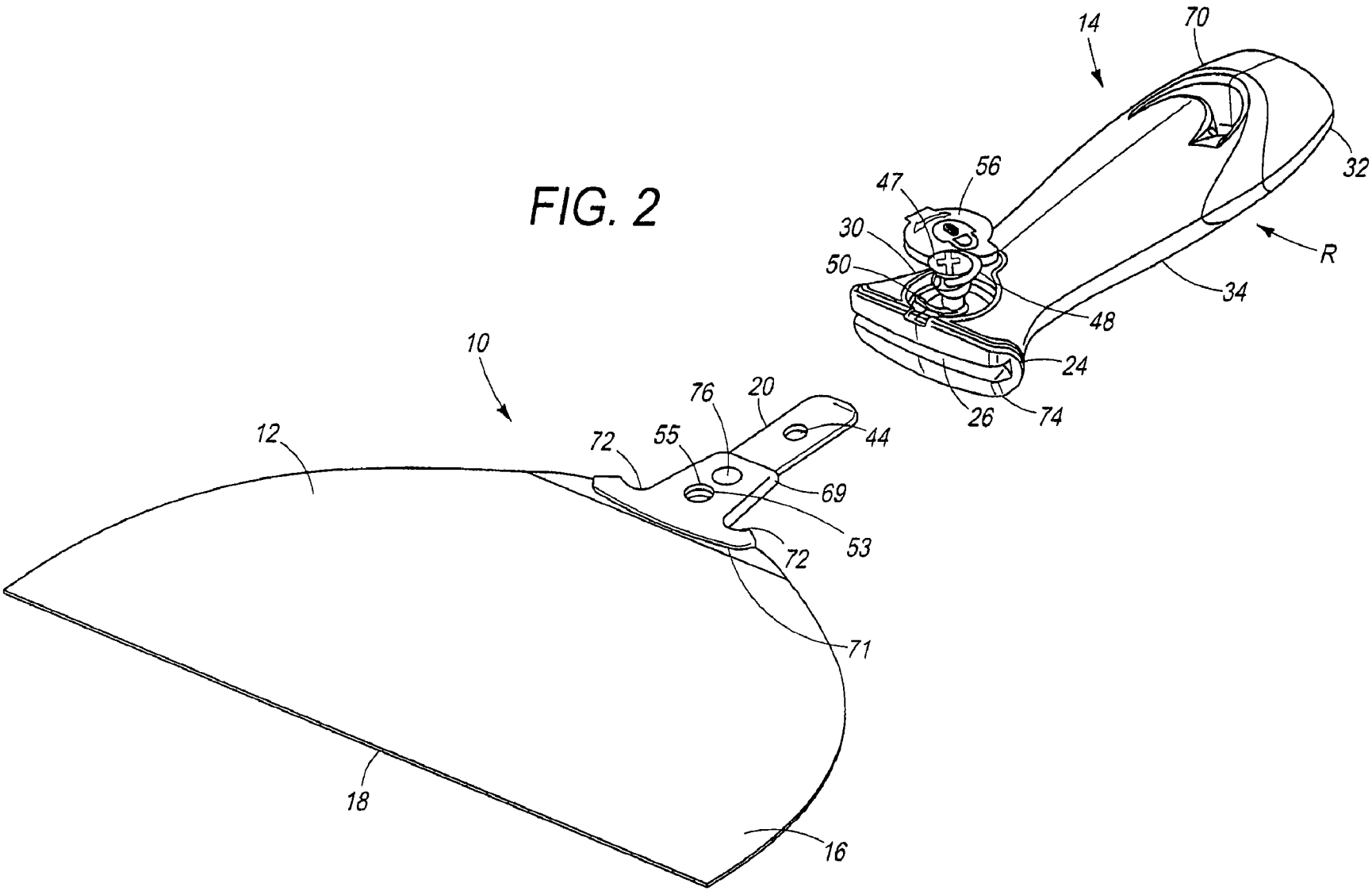
FIG. 2 is a top perspective, partially exploded view of the taping knife of FIG. 1 in which the blade is shown in a removed position with respect to the handle.

Referring to FIGS. 1 and 2, a taping knife generally designated 10 is preferably made with a flat blade 12 and a handle 14. The blade 12 has a working portion 16, a working edge 18, a tang 20 opposite the working portion 16, and a blade sleeve 22 at least partially covering the tang 20. While other materials are contemplated, the working portion 16 of the blade 12 is preferably made primarily out of stainless steel and the blade sleeve 22 of a plastic material, such as polypropylene. The handle 14 of the tool 10 preferably has a blade chamber 24 that defines a blade chamber cavity 26 into which the blade 12 is inserted, locking elements 28, 30 that help to retain the blade in the handle, a hammer element 32, and a resilient overlay 34 that provides for a strong yet comfortable grip.

As is fairly common in the art, the handle 14 is preferably made of a pair of opposing housing halves 15 which encompass the blade chamber 24 and are made of a rigid material such as molded plastic or the like. It is preferred that the blade chamber 24 is retained in the handle 14 by one or more blade chamber retaining elements 38, such as rivets. Preferably, the retaining elements 38 pass through blade chamber retaining element receiving portions 40 that are defined by the blade chamber 24 and located in several areas of the blade chamber. It is contemplated that certain of the rivets 38 are covered by rivet covers 42 engaged in external recesses of the handle halves 15 so that the handle 14 has a generally smooth surface.

A feature of the present tool 10 is that the blade 12 is releasably secured in the handle 14 by at least two mechanisms, preferably using distinct fastening or clamping technologies. The first releasable locking element 28 of the handle 14 is preferably a biasing element such as a spring ball. The first locking element 28 preferably provides an automatic, audible and/or tactile indicator of a positive connection between the tang 20 of the blade 12 and the blade chamber 24 of the handle 14 upon insertion. In embodiments in which a spring ball 28 is the biasing element, the tang 20 of the blade 12 preferably defines a hole that serves as a first locking element receiving portion 44.

When the blade 12 is inserted into the blade chamber 24, the edge of the tang 20 displaces the spring ball 28 into a compressed position. In a preferred embodiment, the edge of the tang 20 opposite the working portion 16 is tapered to more easily displace the spring ball. When the blade 12 is fully inserted, the spring ball 28 moves into a de-compressed position as it enters into the first locking element receiving portion 44 of the tang 20, and the blade 12 is thereby retained in the handle 14.

In certain embodiments, the blade chamber 24 has a first locking element guiding portion 46 that helps to keep the first locking element 28 in the correct location within the handle 14. For instance, in FIG. 6 the guiding portion 46 has a tubular, sleeve-like configuration for providing a space in which the spring ball 28 resides.

Preferably, the second locking element 30 of the tool 10 is user actuated and is in the form of a lock screw. The use of a lock screw 30 helps to provide a tight friction fit which decreases movement of the blade 12 with respect to the handle 14, especially in a plane perpendicular to the blade. In embodiments in which the tang 20 has a tapered edge, the edge can be used as a screwdriver to remove the lock screw 30. Besides having a head 47 that can receive conventional screw drivers, in a preferred embodiment, the lock screw 30 has a swiveling D-ring 48 which moves between a retracted or storage position, and a raised or operative position so that the D-ring is positionable to be parallel and in line with a shank of the lock screw. When the D-ring 48 is in this position, it is simpler for a user to screw and unscrew the locking element 30 without the use of a screwdriver or other tools.

Figure 6:
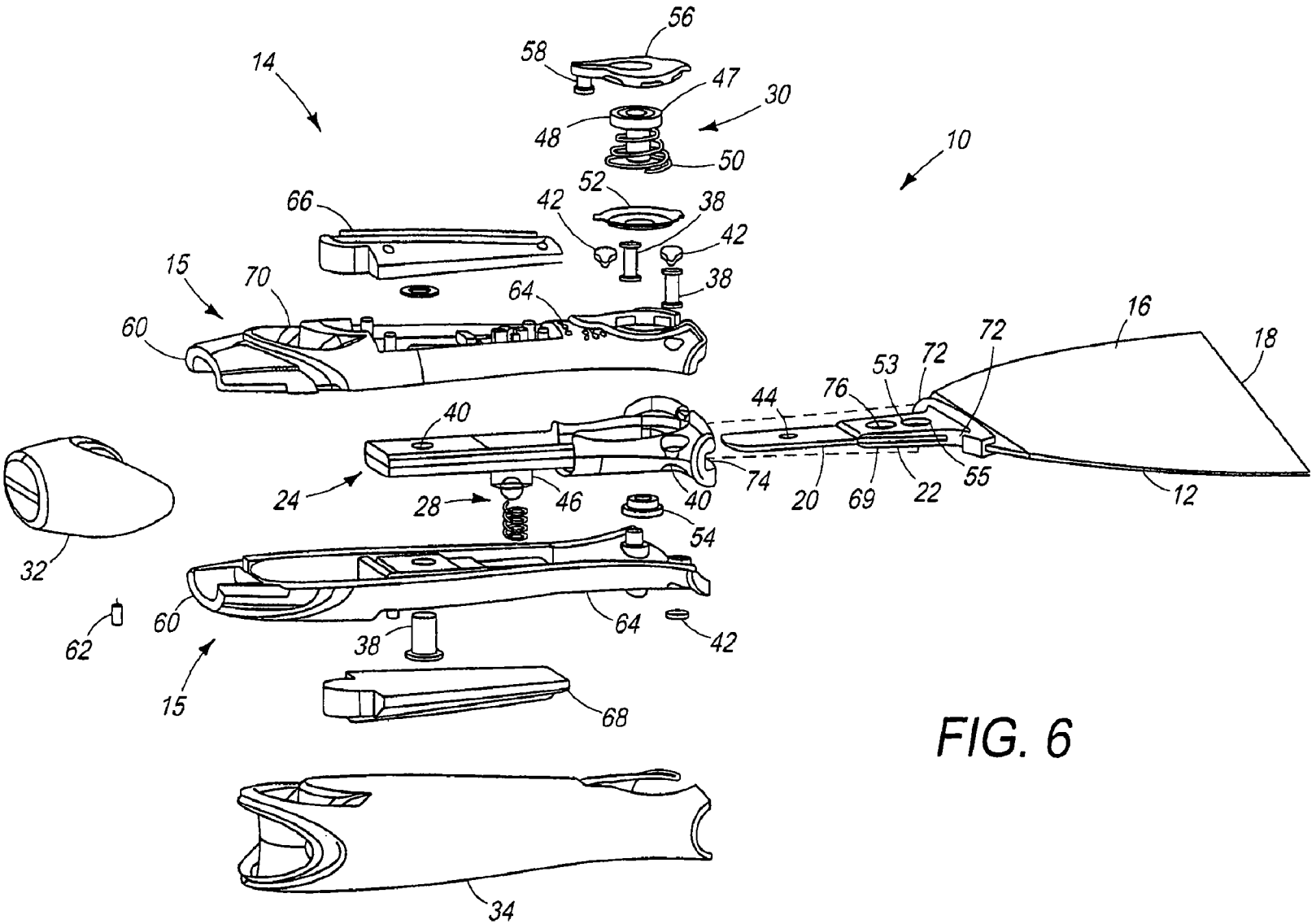
FIG. 6 is an exploded perspective view of the taping knife of FIG. 1.
Figure 7:
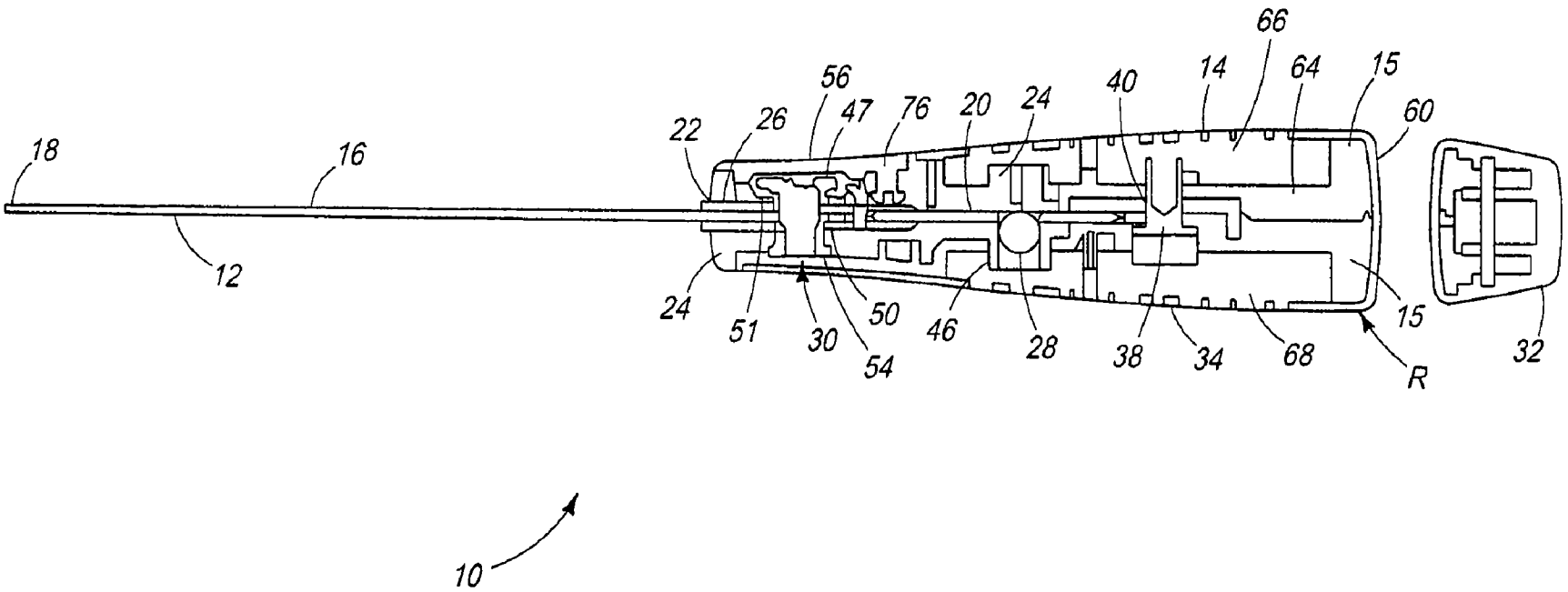
FIG. 7 is a cross section of the taping knife taken along line 7-7 of FIG. 1 and in the direction generally indicated.
Figure 8:
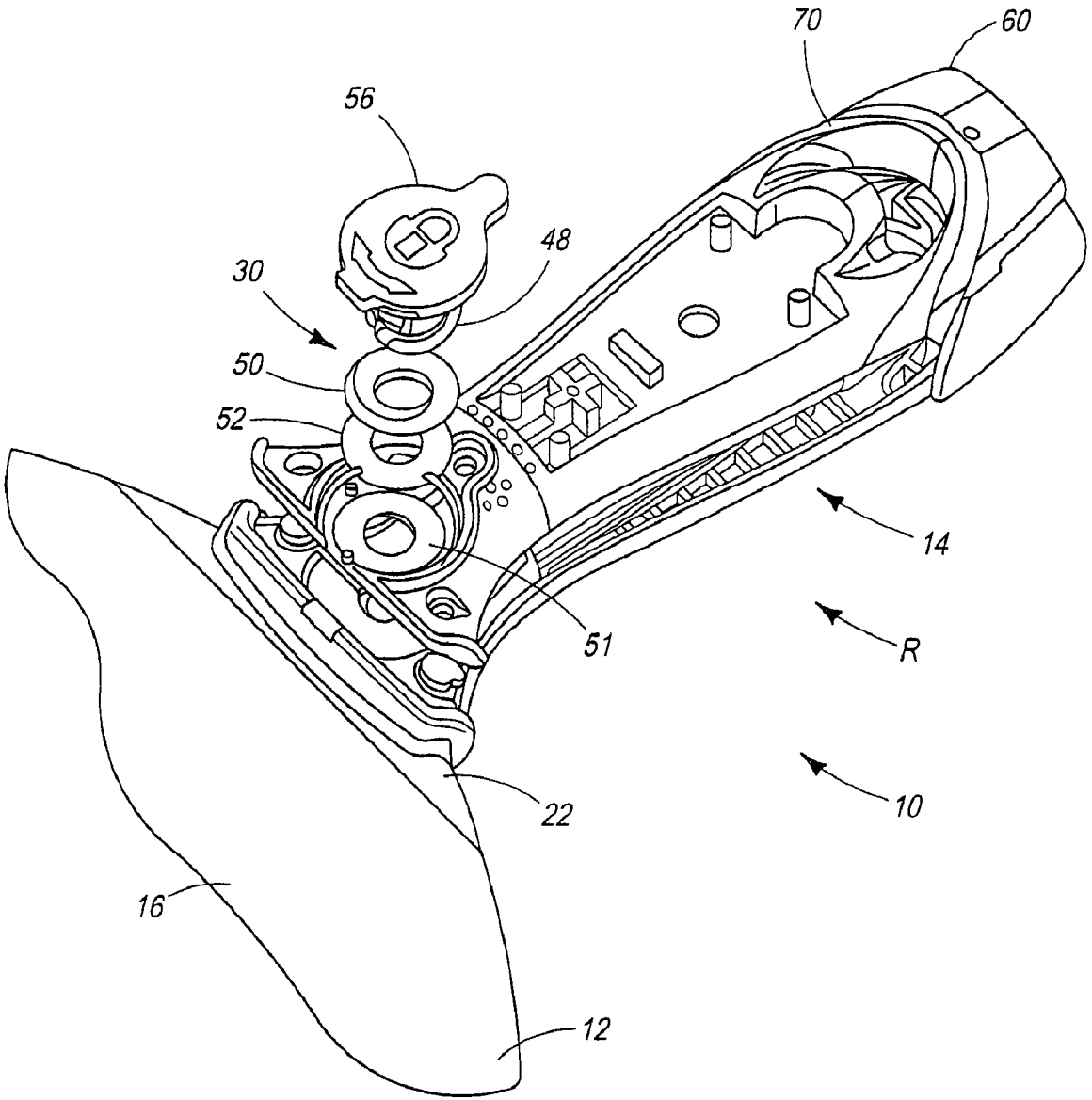
FIG. 8 is a top fragmentary perspective view of an embodiment of the present handle.

Referring to FIGS. 6 and 8, an optional conical spring 50 is attached to the lock screw 30 to aid in retaining the lock screw on the handle 14 when it is in the unlocked position. Preferably, the conical spring 50 rests in a lock screw washer 52 when the lock screw 30 is in a locked position. It is noted that the conical spring 50 has added benefits of taking up less volume in the lock screw washer 52 when in the locked position, as well as assisting to force the lock screw 30 away from the lock screw washer 52 when the lock screw is being unscrewed. Moreover, the lock screw washer 52 provides for a large surface area that transfers compressive force more broadly across the handle 14 than a lock screw 30 alone, which in turn results in a greater surface area of the handle contacting the blade 12. This helps to provide a better positive connection between the handle 14 and the blade 12. The second locking element 30 in a preferred embodiment is retained in the handle by a second locking element retaining element 54. In the case of a lock screw 30, the second locking element retaining element 54 is a lock screw nut located between one of the housing halves 15 and an opposite side of the blade chamber 24 from the lock screw washer 52.

In a preferred embodiment, the lock screw washer 52 rests in a washer seat 51 within the handle 14 as shown in FIG. 8. When the lock screw 30 is in a locked position, the washer seat 51 is compressed against the blade chamber 24 and acts like a vise to retain the blade 12 in the chamber 24. The washer seat 51 has a slight flex to it or is otherwise biased so that when the lock screw 30 is in an unlocked position, the washer seat does not rest against the blade chamber 24. This helps decrease the amount of pressure exerted on the blade 12 so that it can be easily released from the handle 14.

Preferably, the second locking element 30 passes through a second locking element receiving portion 53 that is defined by the tang 20. In a preferred embodiment, the blade sleeve 22 also defines a second locking element receiving portion 55, which is in registry with the corresponding formation 53 on the tang 20, and the second locking element 30 passes through both the second locking element receiving portion 53 of the tang 20 and the second locking element receiving portion 55 of the blade sleeve 22 as shown in FIGS. 2 and 6.

Preferably, in the retracted position, the D-ring 48 of the lock screw 30 is flush with a surface of the handle 12 when the lock screw is in a locked position, and it is covered with a resilient cover 56 that results in a smoother and more uniform surface. It is contemplated that the cover 56 is removable and is rotatable to the side to allow access to the lock screw 30 in certain embodiments. This cover 56 for the user actuated locking element 30 is preferably attached to the handle 14 with a tether 58 (FIG. 6) so that it is not lost when it is removed to access the locking element.

In some embodiments, the hammer element 32 is located on a side opposite the blade 12, and the hammer element is attached to a hammer element receiving portion 60 of the handle 14 using a hammer element retaining element 62 such as a retaining pin. It is contemplated that the hammer element 32 is made out of the same material of the handle 14, but it is preferable that the hammer is made from a harder material relative to the handle. For instance, in one embodiment the handle 14 is made primarily out of polypropylene, and the hammer element 32 is made primarily out of zinc.

While in the preferred embodiment the first locking element is the spring ball 28 and the second locking element is the locking screw 30, it will be appreciated that the identity of the first and second locking elements can be reversed or that both the first and second locking elements can be either the lock screw or the spring ball.

In certain embodiments, the blade chamber 24 is disposed in a blade chamber housing 64 formed by the handle halves 15 that are made primarily out of polypropylene and provides the overall shape to the handle 14. Preferably, first and second identification inserts 66, 68 are attached to the blade chamber housing 64 as show in FIG. 6. Such inserts 66, 68 are constructed and arranged to provide for a relatively smooth transition from the insert to the blade chamber housing 64. In an embodiment, the handle 14 also has an eyelet 70 on the end opposite the blade 12 so that a user can hang the tool 10 on a hook when not in use. It is contemplated that at least some portion of the handle 14 and preferably the blade chamber housing 64 and the inserts 66, 68 are covered with the resilient overlay 34 which provides the user with a comfortable yet strong grip, especially when the tool 10 is used with a viscous fluid such as joint compound.

The blade sleeve 22 helps provide the positive connection between the blade 12 and the handle 14. Preferably, the blade sleeve 22 and blade chamber 24 are constructed and arranged to provide for a jam fit when the blade sleeve is inserted into the blade chamber. This jam fit is beneficial because it will result in less motion of the blade 12 with respect to the handle 14. One configuration of the blade sleeve 22 that is contemplated is a sleeve that has a tang covering portion 69 that is wedge shaped with respect to a plane of the blade 12. This configuration helps provide a jam fit and helps prevent lateral motion of the blade 12 with respect to the handle 14.

An optional feature of the configuration of the sleeve 22 is that it is wedge shaped with respect to a plane perpendicular to the plane of the blade. This configuration helps provide a jam fit and helps restrict motion of the blade 12 with respect to the plane perpendicular to the plane of the blade. Yet another optional configuration for the sleeve 22 is a wedge shape both in a plane of the blade 12 and in a plane perpendicular to the plane of the blade. This configuration helps further in achieving a jam fit and helps to prevent relative motion of the blade 12 laterally and with respect to a plane perpendicular to that of the blade.

In a preferred embodiment, the blade sleeve 22 has blade mating portions 71 that matingly engage with the blade 12, as well as handle mating portions 72 that mate with the handle 14. It is contemplated that the mating of the blade sleeve 22 with the blade chamber 24 of the handle 14 is accomplished by constructing and arranging the handle mating portions 72 of the blade sleeve in a concave configuration with respect to corresponding convex blade sleeve mating portions 74 of the blade chamber 24. The handle mating portions 72 are preferably located lateral to the tang 20. Mating engagement helps decrease the amount of motion or free-play of the blade 12 with respect to the handle 14. Other configurations in addition to concave/convex configurations are also contemplated and are to be considered within the scope of this disclosure.

In certain embodiments, a portion of the blade sleeve 22 covers the tang portion 20 of the blade 12, and a portion of the blade sleeve covers some of the working portion 16 of the blade. When the blade 12 with the blade sleeve 22 is inserted into the blade chamber 24, a positive connection is obtained. That is, the blade sleeve 22 provides for a tight friction fit or jam fit that prevents relative motion of the blade 12 with respect to the handle 14. In certain preferred embodiments, at least a portion of the blade sleeve 22 is made out of a resilient material that provides for a water tight seal between the blade 12 and the handle 14 so joint compound or other materials do not inadvertently enter into the blade chamber cavity 26.

The blade sleeve 22 is preferably fastened to the blade 12, but in certain embodiments it is removably placed on the blade. One method of permanently fastening the blade sleeve to the blade is by use of a rivet 76 as shown in FIG. 6, but other fastening techniques such as the use of chemical adhesives, for example, are also contemplated.

In one preferred embodiment, the blade sleeve 22 is made from a polypropylene material, slid onto the blade 12 from the tang portion 20 and riveted thereto. However, in certain embodiments the blade sleeve 22 is integral to the blade. This is accomplished, for example, if the blade 12 and the blade sleeve 22 are cast as one piece in embodiments in which the blade and the blade sleeve are made out of the same material. In other embodiments, the blade 12 is made out of one type of metal, and the blade sleeve 22 is made out of a different type of metal or plastic and is cast, molded or welded onto the blade.

Figure 9:
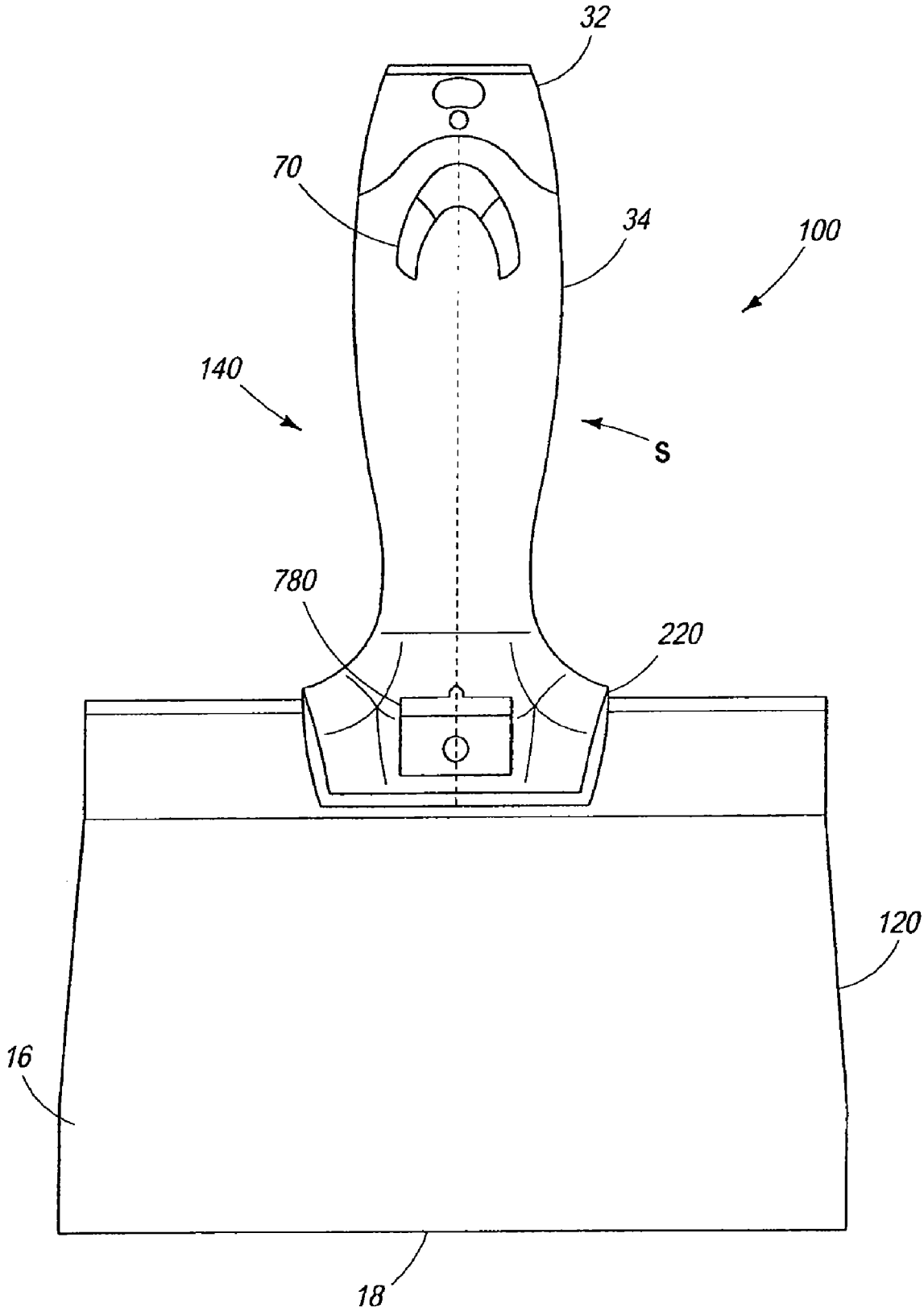
FIG. 9 is a bottom view of an embodiment of the present tool having a rectangular shaped blade and a corresponding indicium.

Different sizes and shapes of blades are contemplated in the present taping knife 10. For instance, certain embodiments of the blade 12 have a generally curved shape opposite the working edge 18 of the blade as shown in FIG. 1. Referring to FIG. 9, an alternate embodiment of the knife 10 is generally designated 100. Components shared with the knife 10 are designated with identical reference numbers. Distinctive features of the knife 100 include a generally rectangular shape of the blade 120 and a handle 140 constructed and arranged to receive the blade. Preferably, the blades 12, 120 are interchangeably inserted into the handle 14, 140 and are provided in at least a small size (having a working edge that is six inches long, for instance) and a large size (having a working edge that is ten inches long for instance). In fact, it is contemplated that different blade sizes are used interchangeably with a single handle 14, 140 so that a user may use a small blade 12 when applying the first coats of joint compound to a wall and then switch to a larger blade when applying a final coat of joint compound. It is also contemplated that a particular handle 14, 140 is configured to receive only one type of blade 12, 120 that has varying sizes, while in other embodiments the handle is configured to receive multiple blade types.

Figure 3:
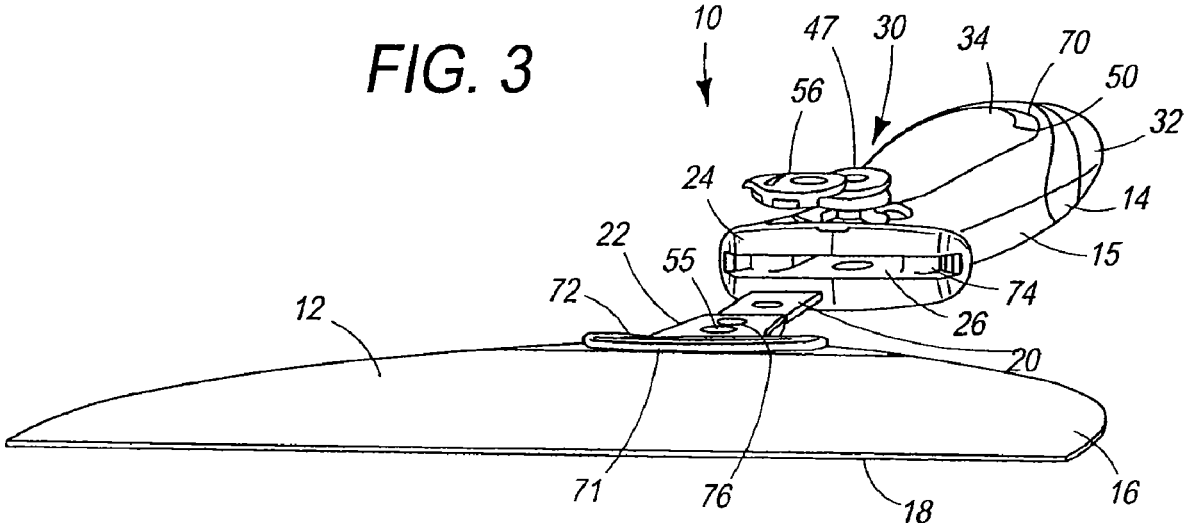
FIG. 3 is an end perspective view of the taping knife of FIG. 2.
Figure 4:
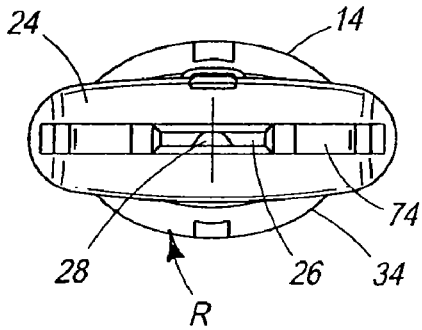
FIG. 4 is a front view of an embodiment of the handle of the present taping knife.

However, in a preferred embodiment a particularly shaped blade 12 is only useable with a handle 14 of a particular type. In such embodiments, the blade sleeve mating portions 74 of the handle 14 are engageable to a blade 12 with a blade sleeve 22 with corresponding blade chamber mating portions 72 that are not able to engage with blade sleeve mating portions of different handle types. For instance, a manufacturer decides to provide handles 12 of a particular type "R." Type "R" handle's blade chamber 24 is constructed and arranged to have curved convex blade sleeve mating portions 74 such as shown in FIGS. 3 and 4. The manufacturer provides all of its blades 12 of varying sizes that are rounded opposite the working edge (as shown in FIG. 1) with blade sleeves 22 that are constructed and arranged to have curved concave blade chamber mating portions 72 that perfectly mate with the curved convex blade sleeve mating portions 74 of the blade chamber 24 when these rounded blades are inserted into the handle 14 of type "R."

Furthermore, in this scenario the manufacturer provides a handle 14 of a particular type "S." The type "S" handle's blade chamber 24 is constructed and arranged to have generally squared convex blade sleeve mating portions (not shown). The manufacturer provides all of its blades 120 of varying sizes that are rectangular in shape (as shown in FIG. 9) with blade sleeves 220 that are constructed and arranged to have squared concave blade chamber mating portions (not shown) that perfectly mate with the squared convex blade sleeve mating portions (not shown) of the blade chamber when these rectangular blades 120 are inserted into the handle of type "S."

Figure 5:
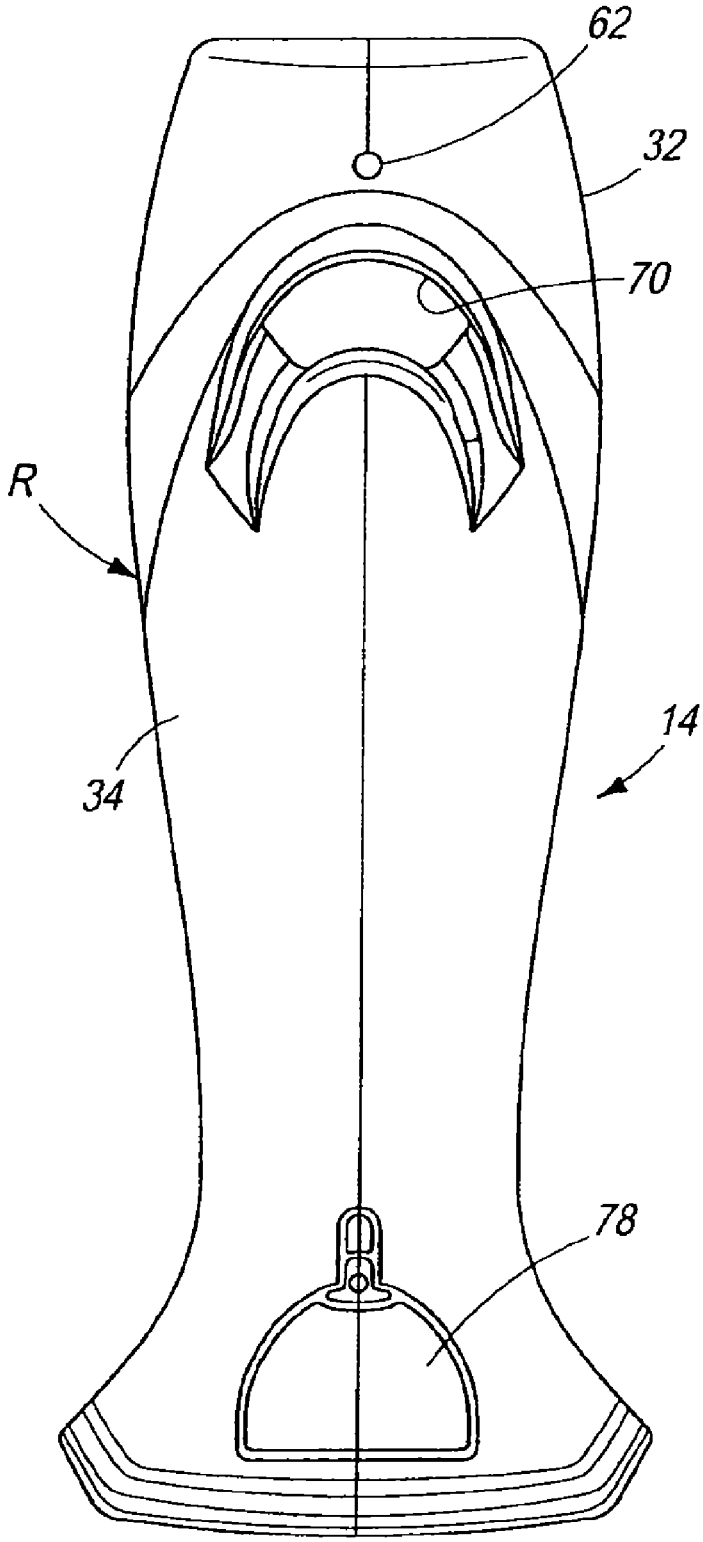
FIG. 5 is a bottom view of an embodiment of the present handle showing an indicium corresponding to an interchangeable blade type.

The rectangular blades 120 would not fit into a type "R" handle 14, and the rounded blades 12 would not fit into a type "S" handle 140. To aid users in identifying which type of blade is used with a particular type of handle, it is contemplated that the manufacturer will imprint or otherwise place an indicium 78, 780 on each handle type that corresponds with an interchangeable blade type. For example, in preferred embodiments handles 14 that can receive rounded blades are imprinted with an indicium 78 that looks like a handle with a rounded blade as is shown in FIG. 5. Handles 140 that can receive rectangular blades 120 are imprinted with an indicium 780 that looks like a handle with a rectangular blade as shown in FIG. 9.

While a particular embodiment of the present taping knife with replaceable blade has been shown and described, it will be appreciated by those skilled in the art that changes and modifications may be made thereto without departing from the invention in its broader aspects and as set forth in the following claims.

The invention claimed is:

1. A tool comprising:

a handle comprising a blade chamber defining a blade chamber cavity and a recessed portion, a first locking element enclosed within said handle, and a second locking element that is user actuated and located in said recessed portion, said second locking element being accessible by the user;

a removable blade comprising a tang engageable in said blade chamber cavity and a working portion;

a blade sleeve, at least a portion of which is located on said tang; and a cover movably connected to said handle and configured to cover said recessed portion.

2. The tool of claim 1 wherein the blade sleeve is affixed to the tang, the first locking element comprises a biasing element and the blade sleeve comprises a blade mating portion and a blade chamber mating portion, the blade mating portion and the blade chamber mating portion configured to provide a mating engagement between the blade and the blade chamber.

3. The tool of claim 2 wherein the handle further comprises a blade chamber housing, a resilient handle overlay and a hammer element.

4. The tool of claim 1 wherein the handle further comprises an indicium that corresponds to an interchangeable blade type, and the removable blade is of the interchangeable blade type that corresponds to the indicium.

5. The tool of claim 2 wherein the blade sleeve is affixed to the blade and the blade sleeve provides a jam fit when the blade is inserted into the handle.

6. The tool of claim 5 wherein the blade sleeve further comprises a tang-covering portion, and the tang covering portion is wedge shaped in a plane of the blade.

7. The tool of claim 6 wherein the blade sleeve and the tang-covering portion each comprise a common second locking element receiving portion.

8. The tool of claim 1 wherein the blade chamber cavity is configured to receive the blade via a jam fit; and the blade sleeve is constructed and arranged to provide a mating engagement that prevents lateral movement of the blade with respect to the handle.

* * * * *